United States Patent [19]

Yoshizawa et al.

[11] Patent Number: 4,851,312

[45] Date of Patent: Jul. 25, 1989

[54] ELECTROPHOTOGRAPHIC PHOTORECEPTOR

[75] Inventors: Shuji Yoshizawa, Tokyo; Tatsuya Ikezue, Machida, both of Japan

[73] Assignee: Kabushiki Kaisha Toshiba, Kawasaki, Japan

[21] Appl. No.: 137,342

[22] Filed: Dec. 23, 1987

[30] Foreign Application Priority Data

Dec. 26, 1986 [JP] Japan ..... 61-315563

[51] Int. Cl.[4] ..... G03G 5/082; G03G 5/04

[52] U.S. Cl. ..... 430/57; 430/65; 430/67

[58] Field of Search ..... 430/57, 65, 67

[56] References Cited

U.S. PATENT DOCUMENTS

| | | | |
|---|---|---|---|
| 4,683,184 | 7/1987 | Osawa et al. | 430/57 |
| 4,701,395 | 10/1987 | Wronski | 430/57 X |
| 4,720,444 | 1/1988 | Chen | 430/85 X |
| 4,722,479 | 2/1988 | Ueno et al. | 430/57 |

FOREIGN PATENT DOCUMENTS

| | | |
|---|---|---|
| 3511315 | 10/1985 | Fed. Rep. of Germany . |
| 3525359 | 1/1986 | Fed. Rep. of Germany . |

*Primary Examiner*—Paul R. Michl
*Assistant Examiner*—Jeffrey A. Lindeman
*Attorney, Agent, or Firm*—Foley & Lardner, Schwartz, Jeffery, Schwaab, Mack, Blumenthal & Evans

[57] ABSTRACT

An electrophotographic photoreceptor comprising a conductive substrate and a photoconductive layer disposed on the conductive substrate to generate photocarriers upon light radiation. The photoconductive layer comprises a charge-generating layer and a charge-retaining layer. At least part of the charge-generating layer has a plurality of thin microcrystalline semiconductor layers containing silicon as a major constituent and at least one element selected from the group consisting of carbon, hydrogen, and nitrogen. The plurality of microcrystalline layers produce a superlattice structure. The adjacent thin microcrystalline semiconductor layers have different element concentrations. At least part of the charge-retaining layer has a first amorphous semiconductor layer containing silicon as a major constituent and a second amorphous semiconductor layer containing silicon as a major constituent, and at least one element selected from the group consisting of carbon, oxygen, and nitrogen.

14 Claims, 4 Drawing Sheets

ELECTROPHOTOGRAPHIC PHOTORECEPTOR

BACKGROUND OF THE INVENTION

The present invention relates to an electrophotographic photoreceptor for use in electrophotography.

Amorphous silicon containing hydrogen H (to be referred to as a-Si:H hereinafter) has received a great deal of attention as a photoconductive material, and has been used in a variety of applications, such as solar cells, thin film transistors, image sensors, and electrophotographic photoreceptors.

The materials used as the photoconductive layers in conventional electrophotographic photoreceptors can be categorized as either inorganic (e.g., CdS, ZnO, Se, or Se-Te) or organic (poly-N-vinylcarbazole (PVCZ) or trinitrofluorene). The a-Si:H has many advantages over the above-mentioned conventional organic and inorganic materials, such as that it is non-toxic and does not require recovery, high spectral sensitivity in the range of visible light is guaranteed, and its high surface hardness ensures high resistance to wear, and good antiimpact properties. For this reason, a-Si:H is receiving a great deal of attention as a promising electrophotographic photoreceptor.

The a-Si:H material has been developed as an electrophotographic photoreceptor on the basis of the Carlson system. In this case, good photoreceptor properties mean high dark resistance and high sensitivity to light. However, it is difficult to incorporate these two properties in a signal layer photoreceptor. A barrier layer is arranged between the photoconductive layer and a conductive support, and a surface charge-retaining layer is formed on the photoconductive layer, to constitute a multilayer structure, thereby satisfying the two requirements described above.

The a-Si:H material for use as a photoreceptor is prepared by glow discharge decomposition, using a silane gas. During the fabrication process, hydrogen is incorporated in the a-Si:H film, whereby the electrical and optical characteristics thereof are changed greatly, according to the change in hydrogen content. As the amount of hydrogen incorporated in the a-Si:H film increases, the film's optical bandgap widens and its resistance increases. Along with the increase in resistance, the sensitivity to long-wavelength light is degraded. Therefore, it is difficult to use such an a-Si:H film in a laser beam printer utilizing a semiconductor laser. When the content of hydrogen in the a-Si:H film is high, as described above, most of the components in the film can have bonding structures, such as those in (SiH2)n and SiH2, depending on film formation conditions. In this case, the number of voids and hence, the number of silicon dangling bonds, increases, thereby degrading the photoconductive characteristics of the film. Under these circumstances, the film cannot be used as an electrophotographic photoreceptor. However, when the content of hydrogen in the a-Si:H film is low, the optical band gap is narrow and the resistance lower. As a result, the sensitivity to short-wavelength light is increased. A small content of hydrogen causes bonding of hydrogen atoms with the silicon dangling bonds, thus reducing the number of the silicon dangling bonds. For this reason, the mobility of photocarriers is degraded, thereby shortening their lifetime. At the same time, the photoconductive property of the film is degraded and the film cannot be used as an electrophotographic photoreceptor.

SUMMARY OF THE INVENTION

It is an object of the present invention to provide an electrophotographic photoreceptor excellent in charge retaining, dark attenuation, photosensitivity, and environmental resistance properties.

According to the present invention, there is provided an electrophotographic photoreceptor comprising a conductive substrate and a photoconductive layer disposed on the conductive substrate to generate photocarriers upon light radiation. The photoconductive layer comprises a charge-generating layer and a charge-retaining layer. At least part of the charge-generating layer has a plurality of thin microcrystalline semiconductor layers containing silicon as a major constituent and at least one element selected from the group consisting of carbon, hydrogen, and nitrogen. The adjacent thin microcrystalline semiconductor layers have different element concentrations. At least part of the charge-retaining layer has a first amorphous semiconductor layer containing silicon as a major constituent and a second amorphous semiconductor layer containing silicon as a major constituent, and at least one element selected from the group consisting of carbon, oxygen, and nitrogen.

An amount of an element selected to be contained in each microcrystalline semiconductor layer of the first embodiment and each second amorphous semiconductor layer of the second embodiment is preferably 0.5 to 30 atomic % and more preferably 5 to 30 atomic %.

The difference between the respective element concentrations of adjacent thin microcrystalline semiconductor layers is preferably 0.1 to 10 atomic %, and more preferably 1 to 5 atomic %.

The thickness of each microcrystalline semiconductor layer of the charge-generating layer and the first and second amorphous semiconductor layers of the charge-retaining layer is preferably 30 to 500 Å.

A microcrystalline semiconductor containing silicon as a major constituent, that is, microcrystalline silicon (μc-Si) is thought to be formed by a mixture phase of amorphous silicon and microcrystalline silicon having a particle diameter of several tens of angstrom and has the following physical properties. First, microcrystalline silicon has a diffraction pattern for 2 of 28 to 28.5° according to X-ray diffractiometry and can be clearly distinguished from amorphous Si causing only a halo. Second, a dark resistance of μc-Si can be adjusted to be $10^{10}\Omega$.cm or more and can be clearly distinguished from polycrystalline silicon having a dark resistance of $10^{5}\Omega$.cm.

An optical band gap (Eg) of μc-Si used in the present invention can be arbitrarily set to fall within a predetermined range. The optical band gap is preferably set to be, e.g., 1.55 eV. In this case, in order to obtain a desirable Eg°, hydrogen is preferably added to obtain μc-Si:H.

In the electrophotographic photoreceptor according to the present invention, the content of hydrogen in a-Si:H and μc-Si:H is preferably 0.01 to 30 atomic % and more preferably 1 to 25 atomic %. This amount of hydrogen compensates for dangling bonds of silicon and provides a good balance between the dark resistance and the bright resistance, thereby improving the photoconductive property.

An a-Si:H layer can be formed such that a silane series gas such as $SiH_4$ or $Si_2H_4$ as a raw or source gas is supplied to a reaction chamber and a high-frequency power is supplied to the raw gas to cause glow discharge. In this case, hydrogen or hellium gas as a carrier, as needed. However, the material of the source gas is not limited to a silane series gas but can be replaced with a silicon halide gas (e.g., $SiF_4$ or $SiCl_4$) or a mixture of a silane series gas and a silicon halide gas. The a-Si:H layer can be formed not only by the glow discharge method but also by a physical method such as sputtering.

A μc-Si layer can be formed by the high-frequency glow discharge method using silane gas as a raw gas in the same manner as in the a-Si:H layer. In this case, if a film formation temperature is higher than that of the a-Si:H layer, and a high-frequency power for the μc-Si layer is also higher than that of the a-Si:H layer, a μc-Si:H layer is easily formed. Furthermore, when a higher substrate temperature and a higher high-frequency power are used, a flow rate of the raw gas such as silane gas can be increased. As a result, the film formation rate can be increased. Furthermore, when a gas prepared by diluting a silane gas of a higher order (e.g., $SiH_4$ or $Si_2H_6$) with hydrogen is used, a μc-Si:H layer can be formed with higher efficiency.

In order to obtain p-type μc-Si:H and a-Si:H, elements belonging to the Group III of the Periodic Table, such as boron (B), aluminum (Al), gallium (Ga), indium (In), and thallium (Tl) are doped in μc-Si:H and a-Si:H. In order to obtain n-type μc-Si:H and a-Si:H, elements belonging to Group V of the Periodic Table, such as nitrogen (N), phosphorus (P), arsenic (As), antimony (Sb), and bismuth (Bi) are preferably doped in c-Si:H and a-Si:H. Doping of the p- or n-type impurity prevents movement of charges from the substrate to the photoconductive layer. When at least one element selected from the group consisting of carbon (C), nitrogen (N), and oxygen (0) is contained in μc-Si:H and a-Si:H, the resultant layers have a high resistance and a high surface charge retaining capacity.

As described above, in the electrophotographic photoreceptor, at least part of the photoconductive layer is constituted by the plurality of stacked thin layers having different optical band gaps. In this manner, since the thin layers having different optical band gaps are stacked, a superlattice structure can be obtained such that a layer having a larger optical band gap serves as a barrier with respect to a layer having a small optical band gap irrespective of the absolute magnitudes of the optical band gaps so as to constitute a periodic potential barrier pattern. In the superlattice structure, since the layers constituting the barrier are very thin, carriers can pass through the barrier and move in the superlattice structure by the tunnel effect of the carriers in the thin layers. In addition, in such a superlattice structure, a large number of carriers are generated, and they have a long lifetime and a high mobility. For these reasons, the sensitivity of the electrophotographic photoreceptor can be greatly improved. The mechanism for this improvement cannot be perfectly clarified. However, the improvement may be regarded as a quantum effect by a periodic well type potential unique to the superlattice structure. This effect is called a superlattice effect.

By changing the band gap and thickness of the thin layer in the superlattice structure, the apparent band gap may be arbitrarily adjusted.

DETAILED DESCRIPTION OF THE PREFERRED EMBODIMENTS

Various embodiments of the present invention will now be described in detail with reference to the accompanying drawings.

Figure 1:
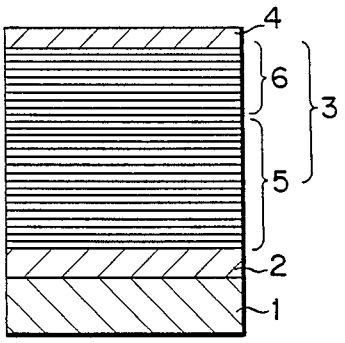
FIG. 1 is a sectional view of an electrophotographic photoreceptor according to one embodiment of the present invention.

FIG. 1 is a sectional view of electrophotographic photoreceptors, according to one embodiment of the present invention.

In the electrophotographic photoreceptor shown in FIG. 1, barrier layer 2 is formed on conductive substrate 1, photoconductive layer 3 consisting of charge-retaining layer 5 and charge-generating layer 6 formed on barrier layer 2, and surface layer 4 is formed on photoconductive layer 3. Charge retaining layer 5 and charge-generating layer 6 have a superlattice structure.

Figure 2:
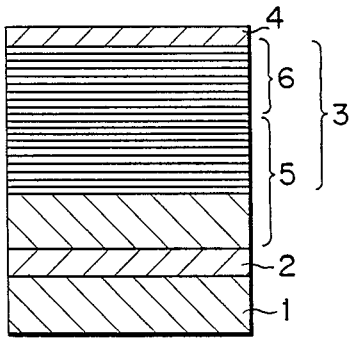
FIGS. 2 to 4 are sectional views of an electrophotographic photoreceptor according to the other embodiments of the present invention.
Figure 3:
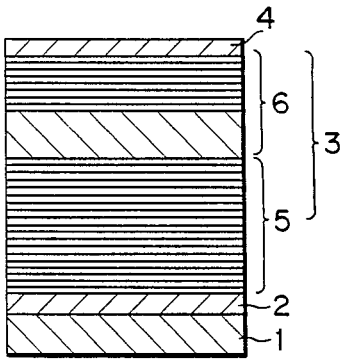
Figure 4:
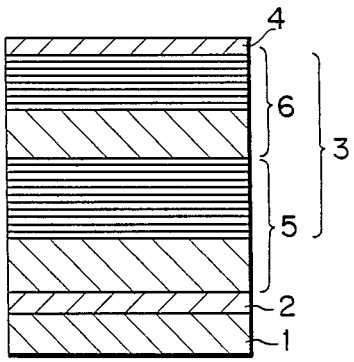

FIGS. 2 to 4 are sectional views of electrophotographic photoreceptors, according to the other embodiments of the present invention.

In the electrophotographic photoreceptor shown in FIG. 2, a part of charge-generating layer 6 has a superlattice structure. In the electrophotographic photoreceptor shown in FIG. 3, a part of charge-retaining layer 5 has a superlattice structure. And, in the electrophotographic photoreceptor shown in FIG. 4, parts of charge-retaining layer 5 and charge-generating layer 6 have a superlattice structure.

The details of the parts in the embodiment shown in FIGS. 1 and 2 are as follows.

Conductive substrate 1 is normally an aluminum drum.

Barrier layer 2 may be formed using μc-Si, a-Si:H, or a-BN:H (nitrogen- or hydrogen-doped amorphous boron). Barrier layer 2 may be made of an insulating film. For example, at least one element selected from the group consisting of carbon (C), nitrogen (N), and oxygen (O) is contained in μc-Si:H or a-Si:H to form an insulating barrier layer having a high resistance. The thickness of barrier layer 2 is preferably 100 A to 10 μm.

Barrier layer 2 restricts a flow of a charge between conductive substrate 1 and photoconductive layer 3 (or charge-generating layer 6) to improve a charge-retaining capacity on the surface of the photoconductive layer and to improve a charging capacity of the photoconductive layer. Therefore, when a Carlson photoreceptor is manufactured using a semiconductor layer as a barrier layer, barrier layer 2 must have a p or n conductivity type so as not to degrade the charge-retaining capacity of the surface. More specifically, in order to positively charge the surface of the photoreceptor, p-type barrier layer 2 is formed to prevent an injection of electrons into the photoconductive layer for neutralizing the surface charge. However, in order to negatively charge the surface, n-type barrier layer 2 is formed to prevent an injection of holes for neutralizing the surface charge into the photoconductive layer. Carriers injected from barrier layer 2 serve as noise for carriers generated in photoconductive layers 3 and 6 upon the radiation of light. By preventing the carrier injections described above, the sensitivity of the photoconductive layers can be improved. In order to obtain p-type μc-Si:H or p-type a-Si:H, elements belonging to Group III of the Periodic Table, such as boron (B), aluminum (Al), gallium (Ga), indium (In), and thallium (Tl) are preferably doped in c-Si:H or a-Si:H. In order to obtain n-type c-Si:H or n-type a-Si:H, elements belonging to Group V of the Periodic Table, such as nitrogen (N), phosphorus (P), arsenic (As), antimony (Sb), and bismuth (Bi) are preferably doped in c-Si:H or a-Si:H.

In the electrophotographic photoreceptor shown in FIG. 1, charge-generating layer 6 generates carriers upon the reception of incident light. The carriers having one polarity are neutralized with the charge on the surface of the photoreceptor, and the carriers having the other polarity are moved through charge-retaining layer 5 up to conductive substrate 1.

Figure 5:
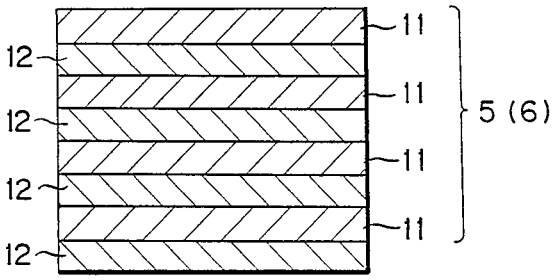
FIG. 5 is a sectional view showing part of FIGS. 1 to 4 in an enlarged scale.

In the embodiment shown in FIG. 1, charge retaining layer 5 and charge-generating layer 6 each have a superlattice structure obtained by alternately stacking thin layers 11 and 12, as shown in FIG. 5. At least one element selected from the group, consisting of carbon, oxygen, and nitrogen, is contained in thin layers 11 and 12 constituting charge-generating layer 6 and in thin layer 11 or 12 constituting charge-retaining layer 5. The concentrations of impurities in the thin layers 11 and 12 constituting charge-generating layer 6 are different from each other. The thickness of thin layers 11 and 12 falls within the range of 30 to 500 Å.

Figure 6:
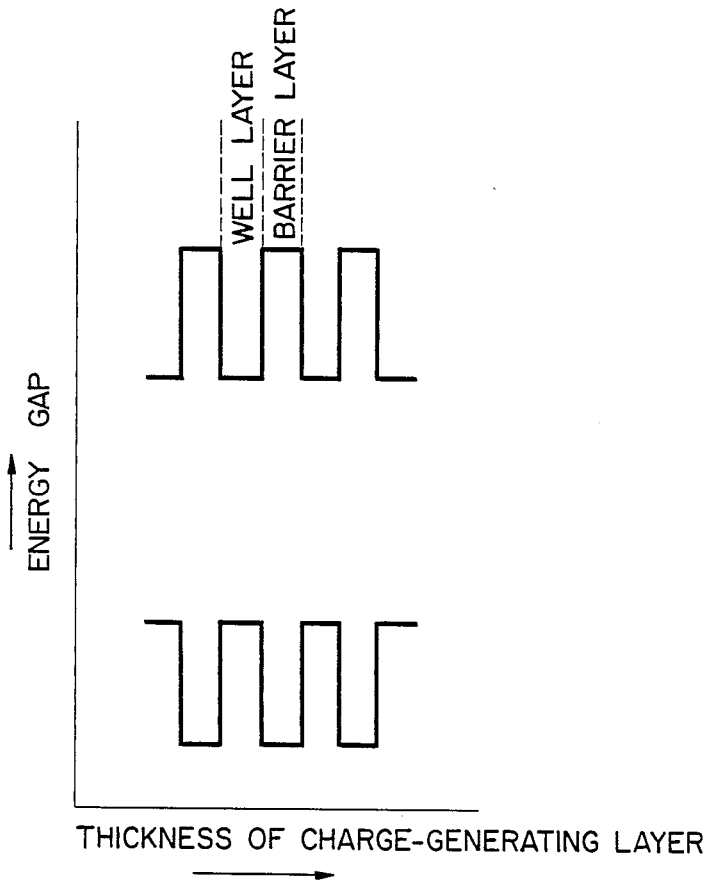
FIG. 6 is a view showing an energy band of the superlattice structure.

FIG. 6 is a graph showing an energy band of the superlattice structure. The direction of thickness is plotted along the ordinate, and the optical band gap is plotted along the abscissa.

Surface layer 4 is formed on charge-generating layer 6. The refractive index of μc-Si:H or a-Si:H, constituting charge-generating layer 6, is as relatively large as 3 to 3.4, and reflection tends to occur on the surface of the layer. When such reflection occurs, the amount of light to be absorbed in the charge-generating layer is decreased, and optical loss typically occurs. For this reason, surface layer 4 is preferably formed to prevent light reflection. In addition, surface layer 4 prevents charge-generating layer 6 from being damaged. Furthermore, the formation of the surface layer allows for the improvement of the charging capacity, and the surface can be satisfactorily charged. A material of the surface layer is an inorganic compound (e.g., a-SiN:H, a-SiO:H, or a-SiC:H) or an organic material (e.g., polyvinyl chloride or polyamide).

Figure 7:
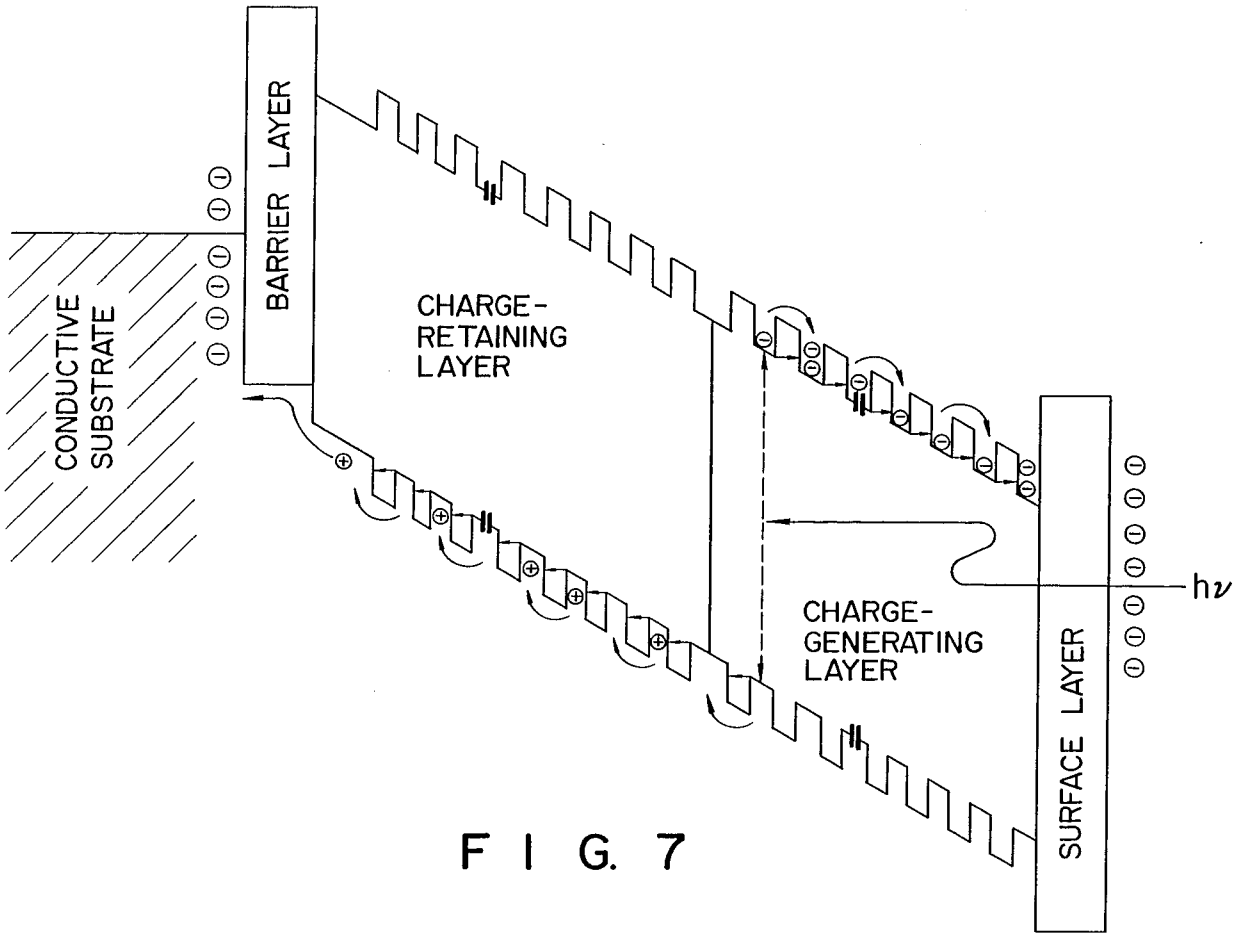
FIG. 7 is a schematic view of an energy gap of a photoreceptor according to the present invention.

When the surface of the electrophotographic photoreceptor is negatively charged by corona discharge with a voltage of about 500 V, a potential barrier shown in FIG. 7 is formed. When light ($h\nu$) is incident on the photoconductive layer, carriers, i.e., electrons and holes, are generated in the superlattice structure of charge-generating layer 6. The electrons in the conduction band are accelerated toward surface layer 4 by an electric field in the photoreceptor, while the holes are accelerated toward conductive substrate 1. In this case, the number of carriers generated at an interface between the adjacent thin layers having different optical band gaps is larger than that generated in the bulk. For this reason, in this superlattice structure, high light sensitivity can be obtained. In the potential well layer, due to the quantum effect, the carrier lifetime is 5 to 10 times that of a single layer which is not a superlattice structure. In addition, in the superlattice structure, discontinuity of the band gaps forms periodic barrier layers. However, the carriers can easily pass through the bias layer by the tunnel effect, so that the effective mobility of the carriers is substantially the same as that in the bulk, thus achieving high-speed carrier movement.

Also in the potential well layer of charge-retaining layer 5, due to the quantum effect, the carrier lifetime is 5 to 10 times that of a single layer which is not a superlattice structure. In addition, in the superlattice structure, discontinuity of the band gaps forms periodic barrier layers. However, the carriers can easily pass through the bias layer by the tunnel effect, so that the effective mobility of the carriers is substantially the same as that in the bulk, thus achieving high-speed carrier movement.

As described above, according to the electrophotographic photoreceptor having the charge-generating layer and charge-retaining layer of the superlattice structure wherein thin layers having different optical band gaps are stacked, a good photoconductive property can be obtained, and therefore a clearer image can be obtained as compared with a conventional photoreceptor.

Figure 8:
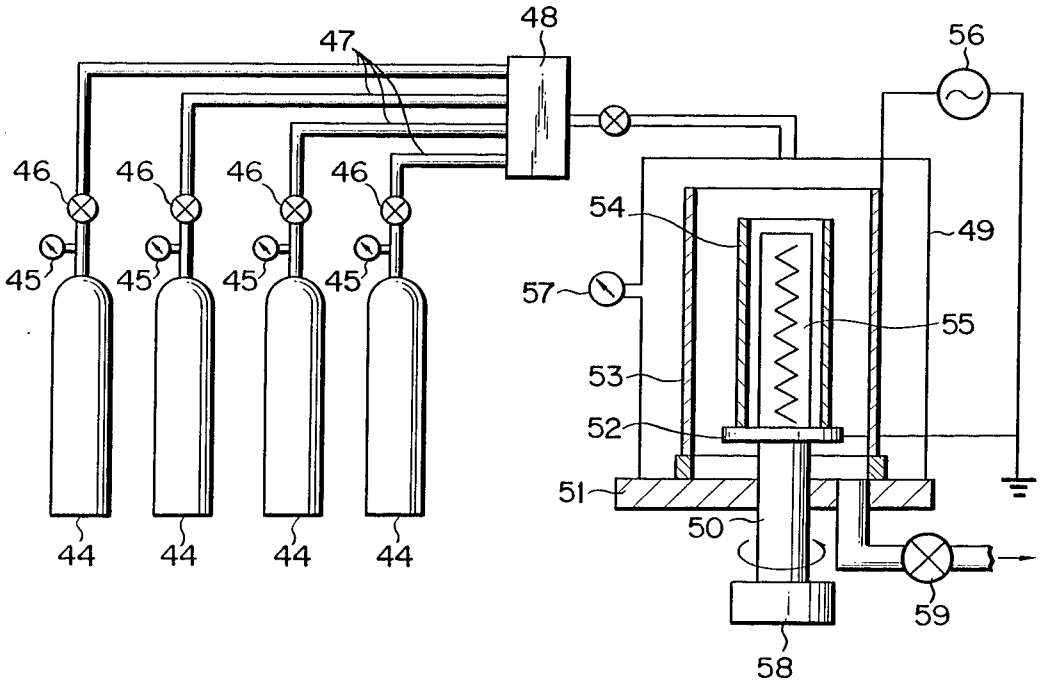
FIG. 8 is a view of an apparatus for manufacturing an electrophotographic photoreceptor of the present invention.

FIG. 8 shows an apparatus for manufacturing an electrophotographic photoreceptor according to the present invention, utilizing the glow discharge method. Gas cylinders 41, 42, 43, and 44 store source gases such as $SiH_4$, $B_2H_6$, $H_2$, and $CH_4$. Gases in cylinders 41, 42, 43, and 44 can be supplied to mixer 48, through flow control valves 46 and pipes 47 respectively. Each cylinder has pressure gauge 45. The operator controls each valve 46 while monitoring corresponding pressure gauge 45, thereby controlling the flow rate of each gas and their mixing ratio. The gas mixture is supplied from mixer 48 to reaction chamber 49. Rotating shaft 10 vertically extends from bottom 11 of reaction chamber 49, and can be rotated about the vertical axis. Disk-like support table 52 is fixed on the upper end of shaft 50 such that the surface of table 52 is perpendicular to shaft 50. Cylindrical electrode 53 is arranged inside chamber 49 such a that the axis of electrode 53 is aligned with the axis of shaft 50. Drum-like substrate 54 for a photoreceptor is placed on table 52 such that the axis of the former is aligned with the axis of shaft 50. Drum-like substrate heater 55 is arranged inside substrate 54. RF power source 56 is connected between electrode 53 and substrate 54, and supplies an RF current therebetween. Rotating shaft 50 is driven by motor 58. The internal pressure of reaction chamber 49 is monitored by pressure gauge 57, and chamber 49 is connected to a proper evacuating means, such as a vacuum pump, through gate valve 59.

In order to manufacture a photoreceptor in the 5 apparatus having the construction described above, drum-like substrate 14 is placed in reaction chamber 49, and gate valve 59 is opened to evacuate chamber 49 to a vacuum of about 0.1 Torr or less. The predetermined gases from cylinders 41, 42, 43, and 44 are supplied to chamber 49, at a predetermined mixing ratio. In this case, the flow rates of the gases supplied to chamber 49 are determined such that the internal pressure of chamber 49 is set to be 0.1 to 1 Torr. Motor 58 is operated to rotate substrate 54. Substrate 54 is heated to a predetermined temperature by heater 55, and an RF current is supplied between electrode 53 and substrate 14, thereby generating a glow discharge therebetween. An a-Si:H layer is deposited on substrate 54. $N_2O$, $NH_3$, $NO_2$, $N_2$, $CH_4$, $C_2H_4$, and $O_2$ gases and the like may be added to the feed gas to add the element N, C, or O in the a-Si:H layer.

As is apparent from the above description, the electrophotographic photoreceptor according to the present invention can be manufactured in a closed-system manufacturing apparatus, thus guaranteeing the safety of the operators. Since the electrophotographic photoreceptor has high resistance to heat, to humidity, and to wear, repeated use thereof does not result in degradation; thus, a long service life is assured.

Electrophotographic photoreceptors according to the present invention were formed, and their electrophotographic characteristics were tested in the following manner.

EXAMPLE 1

An aluminum drum substrate having a diameter of 80 mm and a length of 350 mm and subjected to acid, alkali, and sandblast treatments as needed to prevent interference, was mounted in a reaction chamber, and the interior of the reaction chamber was exhausted by a diffusion pump (not shown) to obtain a vacuum pressure of about 10−5 Torr. Thereafter, the drum substrate was heated to a temperature of 250° C. and rotated at 10 rpm, and an $SiH_4$ gas with a flow rate of 500 SCCM, a $B_2H_6$ gas with a ratio of flow rate of $10^{-5}$ with respect to the $SiH_4$ gas, and a $CH_4$ gas with a flow rate of 100 SCCM were supplied into the reaction chamber, so that the interior of the reaction chamber was adjusted to be 1 Torr. Then, a high-frequency electric power of 13.56 MHz was applied to an electrode to generate plasma of $SiH_4$, $B_2H_6$, and $CH_4$ between the electrode and the substrate, thereby forming a barrier layer consisting of p-type a-SiC:H.

High-frequency discharge was temporarily interrupted, an $NH_3$ gas was supplied at a flow rate of 120 SCCM, a reaction pressure was controlled to 1.2 Torr, and a 500-W high-frequency power was applied to the chamber, thereby forming a 100-Å thick a-SiN:H thin layer. The flow rate of the $SiH_4$ gas was then controlled to 500 SCCM, and $B_2H_6$ was supplied at a flow rate ratio of $10^{-7}$ with respect to the $SiH_4$ gas. A 500-W high-frequency power was applied to the reaction chamber to form a 100-Å thick a-Si:H thin layer. The above operations were repeated to alternately form 600 a-SiN:H thin layers and 600 a-Si:H thin layers to obtain a 1.2 μm thick charge-retaining layer having a heterojunction superlattice structure.

Thereafter, discharge was temporarily stopped, and the $SiH_4$, $CH_4$, and $H_2$ gases, respectively with flow rates of 50, 7, and 450 SCCM were supplied into the reaction chamber to adjust the reaction pressure to be 1.2 Torr. Then, the high-frequency electric power of 800 W was applied to form a 100-Å thin μc-SiC:H layer (carbon content: 0.5 atomic %).

The flow rate of the $CH_4$ gas was increased to 9 SCCM, and a 100-Å thick μ-SiC:H thin layer (carbon concentration: 8 atomic %) was formed. This operation was repeated to alternately form 250 μc-SiC:H thin layers and 250 μc-SiC:H thin layers having different carbon concentrations in the adjacent thin layers, thereby forming a 5-μm thick charge-generating layer having a heterojunction superlattice structure.

A 0.5-μm thick a-SiC:H layer was formed as a surface layer.

When the photoreceptor surface thus formed was negatively charged at about 500 V and exposed to white light, the light was absorbed in the charge-generating layer, and photocarriers of electron-hole pairs were generated. In this test example, a large number of photocarriers were generated, and a long lifetime and high propagating property of photocarriers were obtained.

As a result, a clear image of high quality was obtained. In addition, when the photoreceptor manufactured in this test example was repeatedly charged, a transferred image was proved to have very good reproducibility and stability and superior durabilities such as high resistance to corona, humidity, and wear. Furthermore, the photoreceptor thus manufactured has a high sensitivity to light having a long wavelength of 780 to 790 nm which is an oscillation wavelength of a semiconductor laser. When the photoreceptor was mounted in a semiconductor laser printer to form an image by the Carlson process, a clear image was obtained with high resolution even when an exposure amount of the photoreceptor was 25 erg/cm$^2$.

An electrographic photoreceptor was manufactured following the same procedures as in Example 1 except that a 100-Å thick a-SiC:H thin layer was used in place of the 100-Å thick a-SiN:H layer constituting one thin layer of the charge-retaining layer. The a-SiC:H layer was formed by setting the flow rate of the $CH_4$ gas at 75 SCCM and the pressure of the reaction chamber at 1.2 Torr, and applying 500-W high-frequency power.

The resultant photoreceptor was tested following the same procedures as in Example 1, and similar test results were obtained.

Note that in the above examples, a thickness of the charge-generating layer was 5 μm, but it is not limited to this value. For example, when the thickness is set to be, e.g., 1 or 3 μm, the photoreceptor can be similarly put to practical use.

Furthermore, the number of types of the thin films is not limited to two as in the above examples, but three or more types of thin layers may be stacked. More specifically, a boundary need only be formed between thin layers having optical band gaps which are different from each other.

What is claimed is:

1. An electrophotographic photoreceptor comprising:

a conductive substrate;

a barrier layer provided on said substrate;

a photoconductive layer, provided on said barrier layer, for generating photocarriers upon light radiation, said photoconductive layer comprising a charge-generating layer and a charge-retaining layer, and a surface layer overlying said photoconductive layer;

wherein at least part of said charge-generating layer has a plurality of thin microcrystalline semiconductor layers containing silicon as a major constituent, and at least one element selected from the group consisting of carbon, oxygen, and nitrogen, the adjacent thin microcrystalline semiconductor layers having different element concentrations, wherein at least part of said charge-retaining layer has a first amorphous semiconductor layer containing silicon as a major constituent and a second amorphous semiconductor layer containing silicon as a major constituent, and at least one element selected from the group consisting of carbon, oxygen, and nitrogen, and wherein the semiconductor layers each have a thickness of 30 to 500 Angstroms.

2. A photoreceptor according to claim 1, wherein the element concentrations of said thin microcrystalline semiconductor layers fall within a range of 0.5 to 30 atomic %.

3. A photoreceptor according to claim 2, wherein the element concentrations of said thin microcrystalline semiconductor layers fall within a range of 5 to 30 atomic %.

4. A photoreceptor according to claim 1, wherein the difference between the element concentrations of adjacent thin microcrystalline semiconductor layers falls within a range of 0.1 to 10 atomic %.

5. A photoreceptor according to claim 1, wherein the difference between the element concentrations of adjacent thin microcrystalline semiconductor layers falls within a range of 1 to 5 atomic %.

6. A photoreceptor according to claim 1, wherein said thin microcrystalline semiconductor layers contain hydrogen.

7. A photoreceptor according to claim 1, wherein said photoconductive layer contains an element belonging to Group III or V of the Periodic Table.

8. A photoreceptor according to claim 1, wherein the element concentration of said second thin amorphous semiconductor layer falls within a range of 0.5 to 30 atomic %.

9. A photoreceptor according to claim 8, wherein the element concentration of said second thin amorphous semiconductor layer falls within a range of 5 to 30 atomic %.

10. A photoreceptor according to claim 9, wherein said thin first and second amorphous semiconductor layers contain hydrogen.

11. A photoreceptor according to claim 1, wherein the barrier layer is formed between said photoconductive layer and said conductive substrate.

12. A photoreceptor according to claim 11, wherein said barrier layer comprises a microcrystalline semiconductor containing silicon as a main component.

13. A photoreceptor according to claim 1, wherein a surface layer is formed on said photoconductive layer.

14. An electrophotographic photoreceptor comprising:

a conductive substrate;

a barrier layer provided on said substrate;

a photoconductive layer, provided on said barrier layer, for generating photocarriers upon light radiation, said photoconductive layer comprising a charge-generating layer and a charge-retaining layer, and a surface layer overlying said photoconductive layer;

wherein at least part of said charge-generating layer has a plurality of thin microcrystalline semiconductor layers containing silicon as a major constituent and impurities of the concentration of at least zero, the adjacent thin microcrystalline silicon layers having different impurities or different impurity concentrations, wherein at least part of said charge-retaining layer has a plurality of thin amorphous silicon layers containing impurities of the concentration of at least zero, the adjacent thin amorphous silicon layers having different impurities or different impurity concentrations, and wherein the semiconductor layers each have a thickness of 30 to 500 Angstroms and said impurities are selected from the group consisting of carbon, oxygen and nitrogen.

* * * * *